US008727022B2

(12) United States Patent
Dancer

(10) Patent No.: US 8,727,022 B2
(45) Date of Patent: May 20, 2014

(54) SYSTEMS AND METHODS OF SUPPORTING A MULTILATERAL WINDOW

(75) Inventor: William Wallace Dancer, Little Elm, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/878,436

(22) PCT Filed: Jun. 19, 2012

(86) PCT No.: PCT/US2012/043054
§ 371 (c)(1), (2), (4) Date: Apr. 9, 2013

(87) PCT Pub. No.: WO2013/191679
PCT Pub. Date: Dec. 27, 2013

(65) Prior Publication Data
US 2013/0333876 A1 Dec. 19, 2013

(51) Int. Cl.
*E21B 17/08* (2006.01)

(52) U.S. Cl.
USPC ..... 166/380; 166/242.5; 166/242.6

(58) Field of Classification Search
USPC ..... 166/242.5, 242.6, 380, 298, 50, 117.5
See application file for complete search history.

(56) References Cited

U.S. PATENT DOCUMENTS

| | | | | |
|---|---|---|---|---|
| 4,372,562 | A | 2/1983 | Carter, Jr. | |
| 6,279,659 | B1 | 8/2001 | Brunet | |
| 6,550,550 | B2 * | 4/2003 | Hanton et al. | 175/61 |
| 6,848,504 | B2 | 2/2005 | Brunet et al. | |
| 6,854,522 | B2 * | 2/2005 | Brezinski et al. | 166/387 |
| 8,505,621 | B2 * | 8/2013 | Telfer et al. | 166/117.5 |
| 2011/0290476 | A1 * | 12/2011 | Steele et al. | 166/242.6 |

FOREIGN PATENT DOCUMENTS

| | | | |
|---|---|---|---|
| WO | 0125590 | A2 | 4/2001 |
| WO | 2013191679 | A1 | 12/2013 |

OTHER PUBLICATIONS

International Search Report and Written Opinion for PCT/US2012/043054 dated Feb. 27, 2013.

* cited by examiner

*Primary Examiner* — Nicole Coy
(74) *Attorney, Agent, or Firm* — McDermott Will & Emery LLP; Scott Wendorf

(57) ABSTRACT

Disclosed are systems and methods of supporting a multilateral window or casing joint from pressurized collapse. In one embodiment, a casing joint assembly is disclosed and includes a casing joint having a pre-milled window defined therein, a sleeve arranged at least partially about the casing joint and configured to cover the pre-milled window, and one or more reinforcing members arranged about the casing joint and interposing the casing joint and the sleeve. The one or more reinforcing members are configured to provide radial support to the sleeve.

23 Claims, 4 Drawing Sheets

SYSTEMS AND METHODS OF SUPPORTING A MULTILATERAL WINDOW

CROSS-REFERENCE TO RELATED APPLICATIONS

The present application is a National Stage entry of and claims priority to International Application No. PCT/US2012/043054 filed on Jun. 19, 2012.

BACKGROUND

The present invention relates to equipment used in subterranean operations and, in particular, to systems and methods of supporting a multilateral window or casing joint from collapse.

Hydrocarbons can be produced through relatively complex wellbores traversing a subterranean formation. Some wellbores can include multilateral wellbores and/or sidetrack wellbores. Multilateral wellbores include one or more lateral wellbores extending from a parent (or main) wellbore. A sidetrack wellbore is a wellbore that is diverted from a first general direction to a second general direction and can include a main wellbore in the first general direction and a secondary wellbore diverted from the main wellbore in the second general direction. A multilateral wellbore can include one or more windows or casing exits to allow corresponding lateral wellbores to be formed. A sidetrack wellbore can also include a window or casing exit to allow the wellbore to be diverted to the second general direction.

The casing exit for either multilateral or sidetrack wellbores can be formed downhole by positioning a casing joint and a whipstock in a casing string at a desired location in the main wellbore. The whipstock is used to deflect one or more mills laterally (or in an alternative orientation) relative to the casing string. The deflected mill(s) penetrates part of the casing joint to form the casing exit and drill bits can be subsequently inserted through the casing exit in order to drill the lateral or secondary wellbore.

Casing joints are often made from high-strength, non-corrosive materials that are able to withstand corrosive elements present in the subterranean environment, such as hydrogen sulfide and carbon dioxide. Milling the high-strength material to form the casing exit, however, can be difficult and usually creates a large amount of cutting debris that can detrimentally affect well completion and hydrocarbon production operations. For example, accumulated cutting debris can obstruct the retrieval of the whipstock, plug flow control devices, damage seals, obstruct seal bores, and interfere with positioning components in the main bore below the casing joint.

To avoid the accumulation of excessive cutting debris downhole, the casing exit or window is sometimes pre-milled into the casing joint before it is introduced into the wellbore. In such applications, an outer liner is often used to cover the pre-milled window and thereby prevent the influx of particulate materials into the interior of the casing string. The outer liner is typically made of fiberglass or other soft materials and therefore can be milled through quite easily once appropriately positioned downhole.

In the downhole environment, and especially during cementing completion operations, the casing joint often experiences high pressures. To prevent the outer liner from collapsing into the pre-milled window as a result of these pressures, a sleeve is often provided about the exterior of the casing joint at the location of the window. The thought is that the sleeve should able to increase the collapse pressure rating of the window beyond what the outer liner is able to provide.

In cases where there is no pre-milled window, the sleeve may also be used on the interior of the casing joint in order to increase the collapse pressure rating of the casing joint itself.

Nonetheless, there are times where the downhole pressures are so extreme that the sleeve is not sufficient to prevent collapse of the outer liner or casing joint. One method to resolve this problem is to increase the wall thickness of the sleeve or place multiple concentric sleeves at the window or within the casing joint. However, these methods can be prohibitive since added radial size either inwardly or outwardly to the casing joint may pose unreasonably large structural obstructions that can complicate and/or prevent subsequent downhole operations from being accomplished.

SUMMARY OF THE INVENTION

The present invention relates to equipment used in subterranean operations and, in particular, to systems and methods of supporting a multilateral window or casing joint from collapse.

Embodiments disclosed herein include a casing joint assembly. The casing joint assembly may include a casing joint, one or more reinforcing members arranged within the casing joint and biasing an inner surface of the casing joint, and one or more longitudinal deformations defined in the casing joint and being configured to receive the one or more reinforcing members therein, the one or more longitudinal deformations exhibiting a greater inner diameter than remaining portions of the casing joint, wherein the one or more reinforcing members provide radial support to the casing joint.

Embodiments disclosed herein may also include a method of increasing the collapse pressure rating of a casing joint. The method may include arranging one or more reinforcing members within a casing joint, the one or more reinforcing members biasing an inner surface of the casing joint, receiving the one or more reinforcing members in one or more longitudinal deformations defined in the casing joint, each longitudinal deformation exhibiting a greater inner diameter than remaining unexpanded portions of the casing joint, and radially supporting the casing joint with the one or more reinforcing members.

Embodiments disclosed herein may further include another casing joint assembly. The casing joint assembly may include a casing joint having a pre-milled window defined therein, a sleeve arranged at least partially about the casing joint and configured to cover the pre-milled window, and one or more reinforcing members arranged about the casing joint and interposing the casing joint and the sleeve, the one or more reinforcing members being configured to provide radial support to the sleeve.

Embodiments disclosed herein may yet further include another method of increasing the collapse pressure rating of a casing joint. The method may include arranging a sleeve at least partially about a casing joint having a pre-milled window defined therein, the sleeve being configured to substantially cover the pre-milled window, arranging one or more reinforcing members about the casing joint and interposing the casing joint and the sleeve, and radially supporting the sleeve with the one or more reinforcing members.

The features and advantages of the present invention will be readily apparent to those skilled in the art upon a reading of the description of the preferred embodiments that follows.

BRIEF DESCRIPTION OF THE DRAWINGS

The following figures are included to illustrate certain aspects of the present invention, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present invention relates to equipment used in subterranean operations and, in particular, to systems and methods of supporting a multilateral window or casing joint from collapse.

The various casing joint assemblies disclosed herein may be particularly advantageous for use with casing joints that are made from softer materials, such as aluminum, which may be susceptible to collapse upon being subjected to the extreme pressures experienced in a downhole environment. The reinforcing members described herein may be able to help support the walls of the casing joint and help oppose the external pressures which would otherwise collapse the casing joint. The disclosed embodiments may also be advantageous for use with casing joints that have a window pre-milled therein and a sleeve used to seal or otherwise cover the window. The reinforcing members may be able to radially support the sleeve against the extreme downhole pressures and thereby prevent the sleeve from collapsing into the window. Accordingly, the reinforcing members may be configured to increase the collapse pressure rating of casing joints and/or window sleeves beyond what would otherwise be available. The following description contains several other advantages and benefits of the exemplary casing joint assemblies that will become evident to those skilled in the art.

Figure 1:
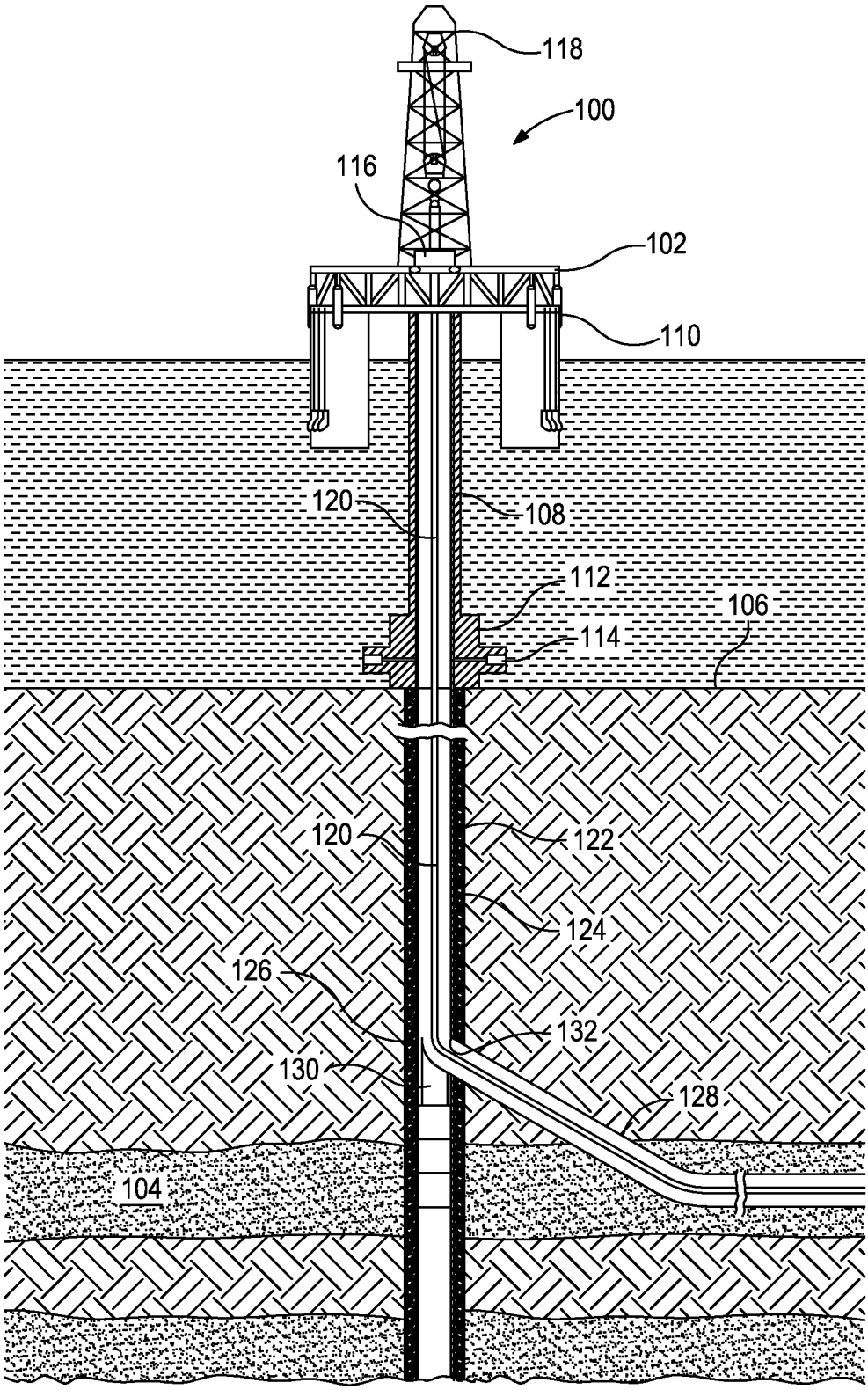
FIG. 1 illustrates an offshore oil and gas platform using an exemplary well system subassembly, according to one or more embodiments disclosed.

Referring to FIG. 1, illustrated is an offshore oil and gas platform 100 that is able to use one or more of the exemplary casing joint assemblies described herein, according to one or more embodiments. Even though FIG. 1 depicts an offshore oil and gas platform 100, it will be appreciated by those skilled in the art that the various embodiments of the casing joint assemblies disclosed herein are equally well suited for use in or on other types of oil and gas rigs, such as land-based oil and gas rigs or rigs located at any other geographical site. The platform 100 may be a semi-submersible platform 102 centered over a submerged oil and gas formation 104 located below the sea floor 106. A subsea conduit 108 extends from the deck 110 of the platform 102 to a wellhead installation 112 that includes one or more blowout preventers 114. The platform 102 has a hoisting apparatus 116 and a derrick 118 for raising and lowering pipe strings, such as a drill string 120, within the subsea conduit 108.

As depicted, a main wellbore 122 has been drilled through the various earth strata, including the formation 104. The terms "parent" and "main" wellbore are used herein to designate a wellbore from which another wellbore is drilled. It is to be noted, however, that a parent or main wellbore does not necessarily extend directly to the earth's surface, but could instead be a branch of another wellbore. A casing string 124 is at least partially cemented within the main wellbore 122. The term "casing" is used herein to designate a tubular string used to line a wellbore. The casing may actually be of the type known to those skilled in the art as "liner" and may be segmented or continuous, such as coiled tubing.

A casing joint 126 may be interconnected between elongate portions or lengths of the casing string 124 and positioned at a desired location within the wellbore 122 where a branch or lateral wellbore 128 is to be drilled. The terms "branch" and "lateral" wellbore are used herein to designate a wellbore which is drilled outwardly from its intersection with another wellbore, such as a parent or main wellbore. Moreover, a branch or lateral wellbore may have another branch or lateral wellbore drilled outwardly therefrom. A whipstock assembly 130 may be positioned within the casing string 124 and/or the casing joint 126. The whipstock assembly 130 may be configured to deflect one or more cutting tools (i.e., mills) into the inner wall of the casing joint 126 such that a casing exit 132 is defined therein at a desired circumferential location. The casing exit 132 provides a "window" in the casing joint 126 through which one or more other cutting tools (i.e., drill bits) may be inserted in order to drill the lateral wellbore 128.

It will be appreciated by those skilled in the art that even though FIG. 1 depicts a vertical section of the main wellbore 122, the embodiments described in the present disclosure are equally applicable for use in wellbores having other directional configurations including horizontal wellbores, deviated wellbores, slanted wellbores, diagonal wellbores, combinations thereof, and the like. Moreover, use of directional terms such as above, below, upper, lower, upward, downward, uphole, downhole, and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2:
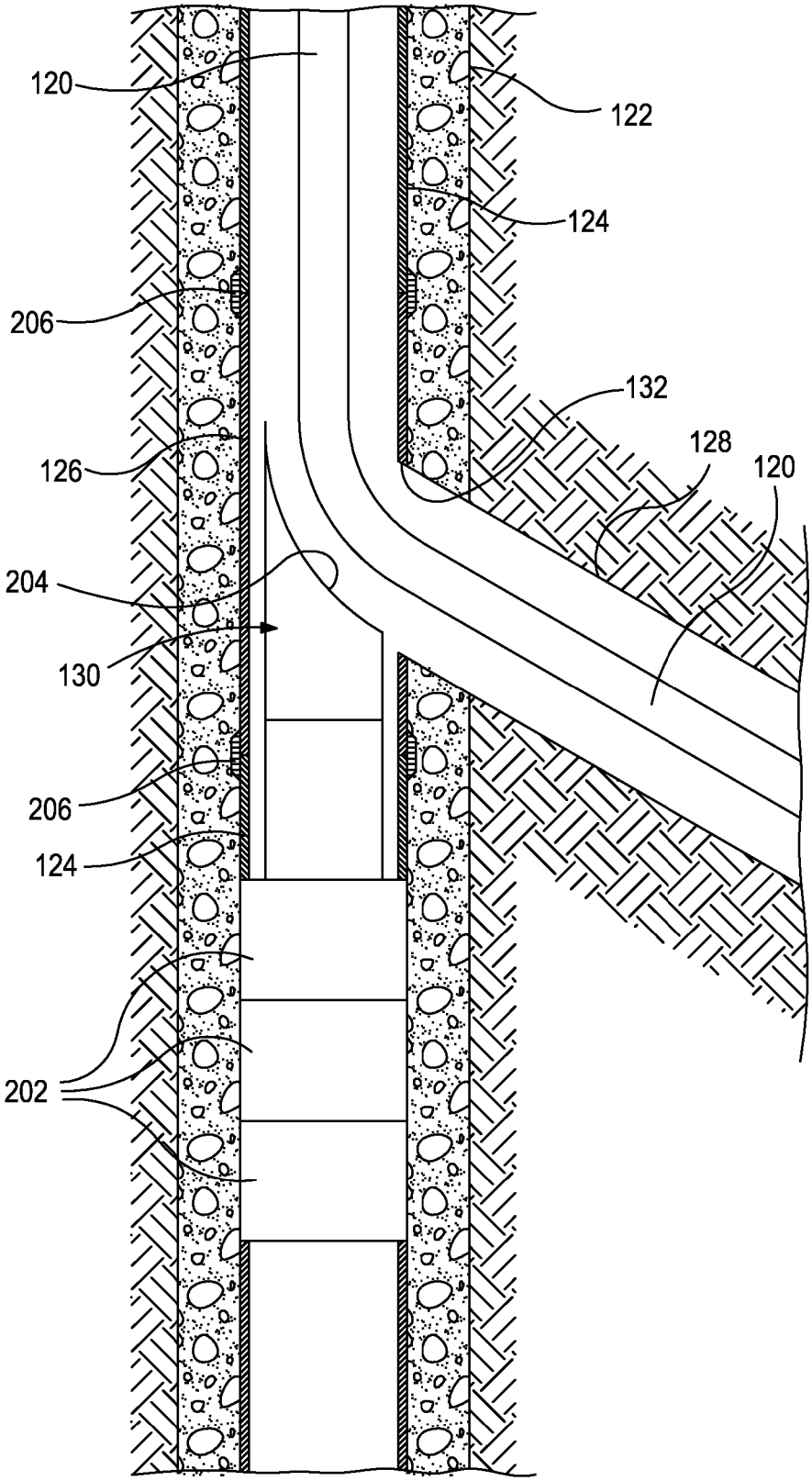
FIG. 2 illustrates an enlarged view of the well system subassembly of FIG. 1.

Referring now to FIG. 2, illustrated is an enlarged view of the junction or intersection between the main wellbore 122 and the lateral wellbore 128, as shown in FIG. 1. As illustrated, the whipstock assembly 130 may be coupled to or otherwise arranged adjacent to various tools and/or tubular lengths 202 either arranged within or interconnected with a portion of the casing string 124. Such tools and/or tubular lengths 202 may be configured to determine the appropriate circumferential angle and orientation for the formation of the casing exit 132. As illustrated, the whipstock assembly 130 may include a deflector surface 204 operable to direct a cutting tool into the sidewall of the casing joint 126 to create the casing exit 132 therethrough.

The casing joint 126 may be coupled to and otherwise interpose separate elongate segments of the casing string 124. In some embodiments, each end of the casing joint 126 may be threaded to the corresponding elongate lengths of the casing string 124. In other embodiments, however, the casing joint 126 may be coupled to the casing string 124 via couplings 206 made of, for example, steel or a steel alloy (e.g., low alloy steel). The casing string 124 may be made from a corrosive-resistant material, such as 13-chromium, 28-chromium, or other stainless steel or nickel alloys.

In some embodiments, the casing joint 126 may be made from a material that is different than the material from which the casing string 124 is made. For example, the casing joint 126 may be made from a softer material than the casing string 124 such that the casing exit 132 can be easily milled or drilled to initiate the formation of the lateral wellbore 128. Examples of materials from which the casing joint 126 may be made include aluminum, aluminum alloys (e.g., 7075 aluminum, 6061 aluminum, or the like), copper-based alloys, magnesium alloys, free-cutting steels, cast irons, carbon fiber, reinforced carbon fiber, fiberglass, low carbon steel alloys (e.g., 1026 steel alloy, 4140 steel alloy, or the like), combinations thereof, or the like. In other embodiments, however, the casing string 124 and the casing joint 126 may be made of the same materials, without departing from the scope of the disclosure.

Figure 3:
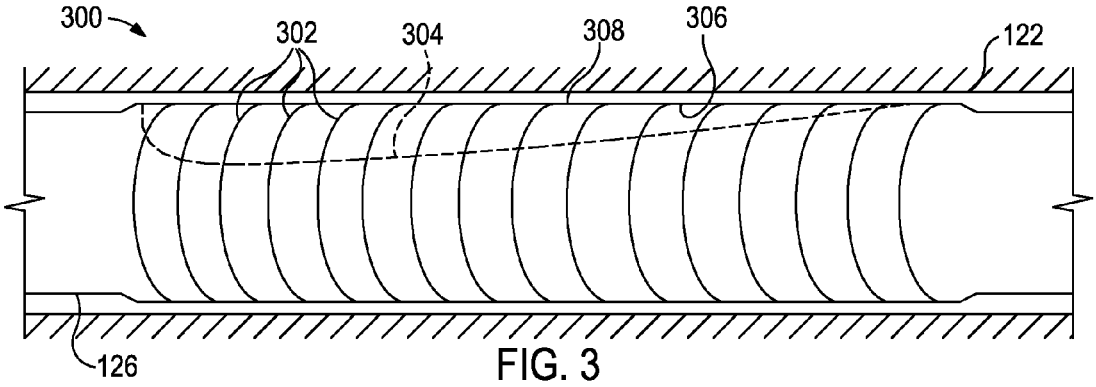
FIG. 3 illustrates an exemplary casing joint assembly, according to one or more embodiments.

Referring now to FIG. 3, illustrated is an exemplary casing joint assembly 300, according to one or more embodiments. The casing joint assembly 300 may be best understood with reference to FIGS. 1 and 2, wherein like numerals will indicate like elements not be described again in detail. As illustrated, the casing joint assembly 300 may include the casing joint 126 and one or more reinforcing members 302 arranged within the casing joint 126. In operation, the casing joint assembly 300 may be arranged within the wellbore 122. It should be noted that while FIG. 3 shows the wellbore 122 in a generally horizontal disposition, having the uphole end extending to the left of the figure and the downhole end extending to the right of the figure, it will be appreciated that any directional configuration may be used, without departing from the scope of the disclosure.

In some embodiments, the casing joint 126 may be configured or otherwise designed such that a window 304 (shown in dashed lines) may eventually be milled therethrough in order to form the casing exit 132 (FIGS. 1 and 2). Accordingly, in at least one embodiment, the casing joint 126 may be made out of a material that is easily milled or otherwise weaker than that of the casing string 124 (FIGS. 1 and 2). For example, the casing joint 126 may be made of aluminum, or any of the other softer materials noted above with reference to the initial description of the casing joint 126. The softer or weaker material, however, may make the casing joint 126 susceptible to collapse from the potential pressures experienced within the wellbore 122. This may be especially evident during cementing operations where pressures within the wellbore 122 may reach and surpass 2500 psi, for example. At such elevated pressures, the weaker material of the casing joint 126 may yield and thereby collapse into its interior.

In order to help resist the collapse of the casing joint 126, the one or more reinforcing members 302 may be arranged within the casing joint 126 substantially adjacent or otherwise in biasing engagement with an inner surface 306 of the casing joint 126. In operation, the one or more reinforcing members 306 may be configured to support the inner surface 306 of the casing joint 126, and thereby help the casing joint 126 resist pressurized collapse as a result of the elevated pressures experienced within the wellbore 122 but exterior to the casing joint 126. As a result, the one or more reinforcing members 302 may serve to increase the collapse pressure rating of the casing joint 126.

In some embodiments, the one or more reinforcing members 302 are coupled or otherwise attached to the inner surface 306 of the casing joint 126 such that they are held in place during operation. The reinforcing members 302 may be coupled to the inner surface 306 of the casing joint 126 using a variety of techniques including, but not limited to, mechanical fasteners, welding or brazing, adhesives, snap rings, castellations, combinations thereof, or the like.

In some embodiments, an axial length of the casing joint 126 may have a longitudinal deformation 308 defined therein. As illustrated in FIG. 3, the longitudinal deformation 308 may be characterized as a radial expansion of the casing joint 126 such that the inner diameter of the longitudinal deformation 308 is greater than the inner diameter of the remaining unexpanded portions of the casing joint 126. The increased inner diameter of the longitudinal deformation 308 may be configured to accommodate or otherwise receive the one or more reinforcing members 302 therein such that the one or more reinforcing members 302 do not obstruct the insertion and/or advancement of other downhole tools (e.g., the whipstock 130, etc.) within the interior of the casing joint 126.

In some embodiments, the one or more reinforcing members 302 are one or more helical springs wound or otherwise designed so as to provide an outwardly-directed radial force against the inner surface 306 of the casing joint 126 that opposes the external pressure directed from the wellbore 122. In other embodiments, the one or more reinforcing members 302 may be a plurality of individual rings equidistantly or randomly spaced apart within the elongate member and configured to support the casing joint 126 against the external pressure of the wellbore 122. In yet other embodiments, the one or more reinforcing members 302 may be a plurality of snap rings, or the like, equidistantly or randomly spaced apart and able to radially expand in order to provide additional radial support to the inner surface 306 of the casing joint 126.

The one or more reinforcing members 302 may be made from a variety of materials. For example, the one or more reinforcing members 302 may be made of metals such as, but not limited to, aluminum alloys, copper alloys, steel alloys, shape memory materials, combinations thereof, and the like. In other embodiments, one or more reinforcing members 302 may be made of a composite material, such as plastics, fiberglass, carbon fiber, combinations thereof, or the like. In yet other embodiments, the one or more reinforcing members 302 are simply made of a material that is able to be milled through in order to access the inner surface 306 of the casing joint 126 and thereby form the window 304.

Figure 4:
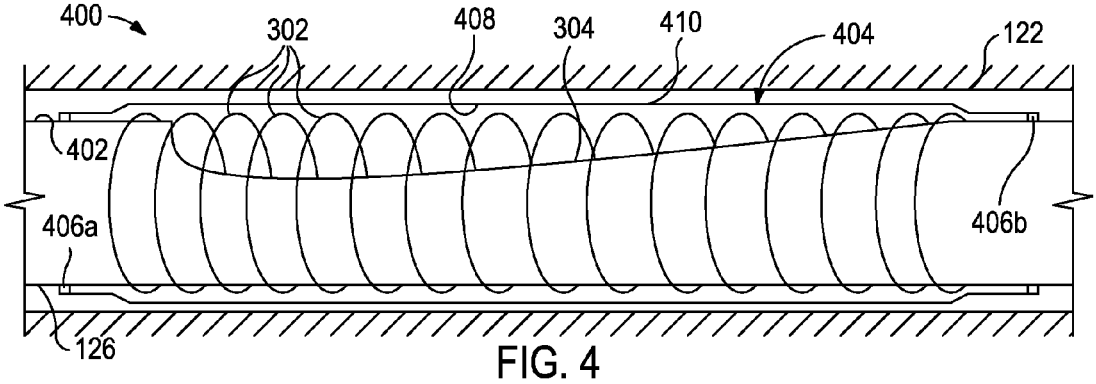
FIG. 4 illustrates another exemplary casing joint assembly, according to one or more embodiments.

Referring now to FIG. 4, illustrated is another exemplary casing joint assembly 400, according to one or more embodiments. The casing joint assembly 400 may be best understood with reference to FIGS. 1-3, where like numerals will indicate like elements not described again in detail. As illustrated, the casing joint assembly 400 may include the casing joint 126 and the one or more reinforcing members 302 arranged thereabout. Specifically, the one or more reinforcing members 302 may be arranged exterior of the casing joint 126, such as adjacent an outer surface 402 of the casing joint 126. In the illustrated embodiment, the casing joint 126 may have the window 304 pre-milled therein before the casing joint 126 is introduced into the wellbore 122.

The casing joint assembly 400 may also include a sleeve 404 arranged about the casing joint 126 and configured to generally align with or otherwise cover the window 304. The sleeve 404, according to various embodiments, may have any suitable configuration, including configurations that surround the entire circumference of the casing joint 126 and configurations that only extend about a portion of the circumference of the casing joint 126. The sleeve 404 may be coupled to the elongate pipe 302 at each end with corresponding coupling devices 406*a* and 406*b*. The coupling devices 406*a,b* may be mechanically or otherwise threadably attached to the casing joint 126 or casing string 124. In some embodiments, the sleeve 404 may be mechanically attached or otherwise fastened to the coupling devices 406*a,b*. In some embodiments, one or more o-rings or other seals (not shown) may be provided at each end of the sleeve 404 to provide a seal between the sleeve 404 and the casing joint 126. As a result, the combined relationship of the casing joint 126 and the sleeve 404 may provide a pressure seal between the interior of the casing joint 126 and the wellbore 122.

The sleeve 404 may be made from any type of suitable material such as, but not limited to, aluminum, aluminum alloys, copper alloys, fiberglass, carbon fiber, fabric reinforced polymer, low carbon steel, combinations thereof, or the like. In some embodiments, such materials may be easily milled and otherwise provide a degree of collapse resistance against pressures experienced in the wellbore 122. In some embodiments, however, the material used to make the sleeve 404 may not individually have a sufficient collapse pressure rating to withstand the elevated pressures experienced in the wellbore 122. As a result, without additional radial support, the sleeve 404 may be susceptible to pressurized collapse into the window 304.

In order to help resist the collapse of the sleeve 404 into the window 304, the one or more reinforcing members 302 may be arranged between the sleeve 404 and the outer surface 402 of the casing joint 126. In this configuration, the one or more reinforcing members 302 may radially support the sleeve 404 and thereby increase its collapse pressure rating in order to withstand the elevated wellbore 122 pressures. In some embodiments, the one or more reinforcing members 302 may be coupled or otherwise attached to the outer surface 402 of the casing joint 126 using the methods and/or techniques described above. In other embodiments, however, the one or more reinforcing members 302 may be coupled or otherwise attached to an inner surface 408 of the sleeve 404, without departing from the scope of the disclosure.

In at least one embodiment, the sleeve 404 may define a longitudinal deformation 410 therein. Similar to the longitudinal deformation 308 described above with reference to FIG. 3, the longitudinal deformation 410 may be characterized as a radial expansion of at least a portion of the axial length of the sleeve 404. Consequently, the longitudinal deformation 410 may have an inner diameter that is greater than the inner diameter of the remaining, unexpanded portions of the sleeve 404. In operation, the increased inner diameter of the longitudinal deformation 410 may be configured to accommodate or otherwise receive the one or more reinforcing members 302, thereby allowing the longitudinal deformation 410 to encase the one or more reinforcing members 302 about the outer surface of the casing joint 126.

Figure 5:
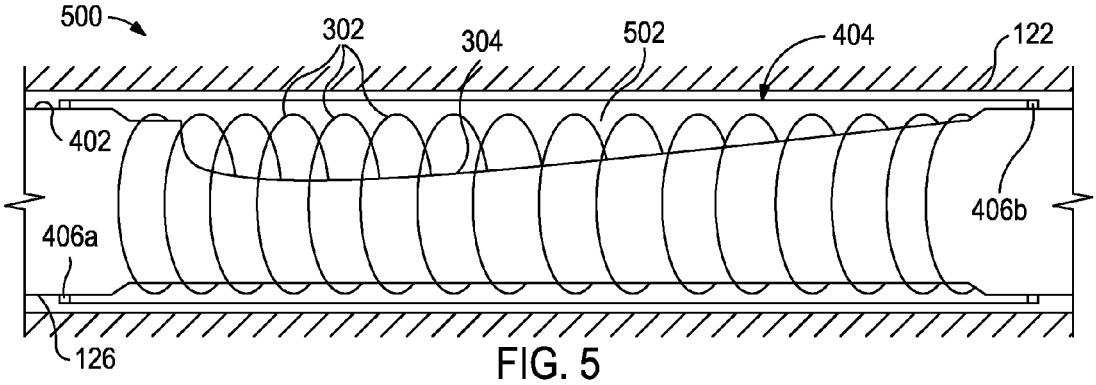
FIG. 5 illustrates another exemplary casing joint assembly, according to one or more embodiments.

Referring now to FIG. 5, illustrated is another exemplary casing joint assembly 500, according to one or more embodiments. The casing joint assembly 500 may be best understood with reference to FIGS. 1-4, where like numerals will indicate like elements not described again. As illustrated, the casing joint assembly 500 may include the casing joint 126 and the one or more reinforcing members 302 arranged about the outer surface 402 of the casing joint 126. Similar to the casing joint assembly 400 of FIG. 4, the window 304 may be pre-milled in the casing joint assembly 500 before its introduction into the wellbore 122, and the sleeve 404 may be arranged about the casing joint 126 and configured to generally align with or otherwise cover the window 304.

Unlike the casing joint assembly 400 of FIG. 4, however, the sleeve 404 does not have the longitudinal deformation 410 formed therein. Instead a longitudinal deformation 502 may be formed or otherwise defined in the casing joint 126. Specifically, the longitudinal deformation 502 may be characterized as a radial indentation in the casing joint 126 such that the inner diameter of the longitudinal deformation 502 is less than the inner diameter of the remaining portions of the casing joint 126. In operation, the longitudinal deformation 502 may be configured to accommodate or otherwise receive the one or more reinforcing members 302 therein and the sleeve 404 may be arranged about the casing string 126 and otherwise coupled to the outer surface 402 in order to seal or otherwise encase the one or more reinforcing members 302 therein.

Figure 6:
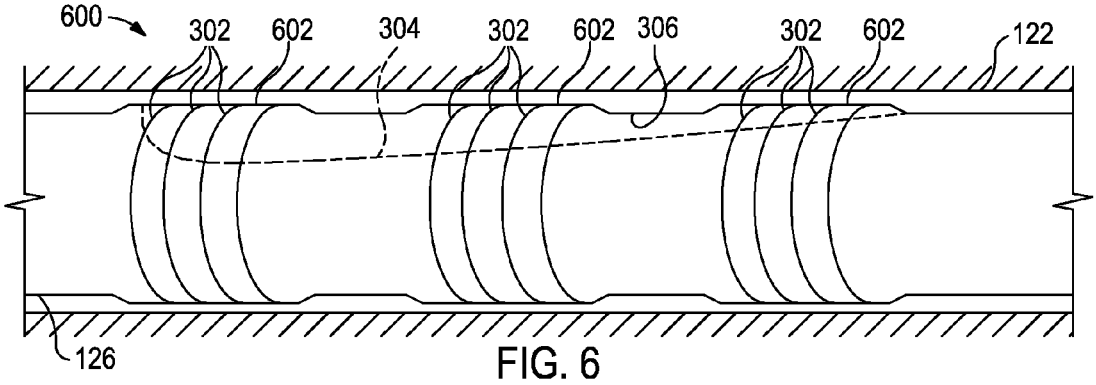
FIG. 6 illustrates another exemplary casing joint assembly, according to one or more embodiments.

Referring now to FIG. 6, illustrated is another exemplary casing joint assembly 600, according to one or more embodiments. The casing joint assembly 600 may be best understood with reference to FIGS. 1-3, where like numerals will indicate like elements not described again. As illustrated, the casing joint assembly 500 may include the casing joint 126 and the one or more reinforcing members 302 arranged about the interior of the casing joint 126, such as adjacent the inner surface 306 of the casing joint 126. In operation, the one or more reinforcing members 306 may be configured to support the inner surface 306 of the casing joint 126, and thereby help the casing joint 126 resist collapse from pressures experienced within the wellbore 122 but exterior to the casing joint 126.

In some embodiments, the casing joint 126 may have two or more longitudinal deformations 602 defined or otherwise formed therein. While FIG. 6 illustrates three longitudinal deformations 602, it will be appreciated that more or less (i.e., two) than three longitudinal deformations 602 may be employed, without departing from the scope of the disclosure. Similar to the longitudinal deformation 308 of FIG. 3, the longitudinal deformations 602 may be characterized as radial expansions of the casing joint 126 such that the inner diameter of each longitudinal deformation 602 is greater than the inner diameter of the remaining, unexpanded portions of the casing joint 126. The longitudinal deformations 602 may be configured to accommodate or otherwise receive a corresponding grouping of the one or more reinforcing members 302 therein such that the one or more reinforcing members 302 do not obstruct the insertion and/or advancement of other downhole tools (e.g., the whipstock 130, etc.) within the casing joint 126.

Figure 7:
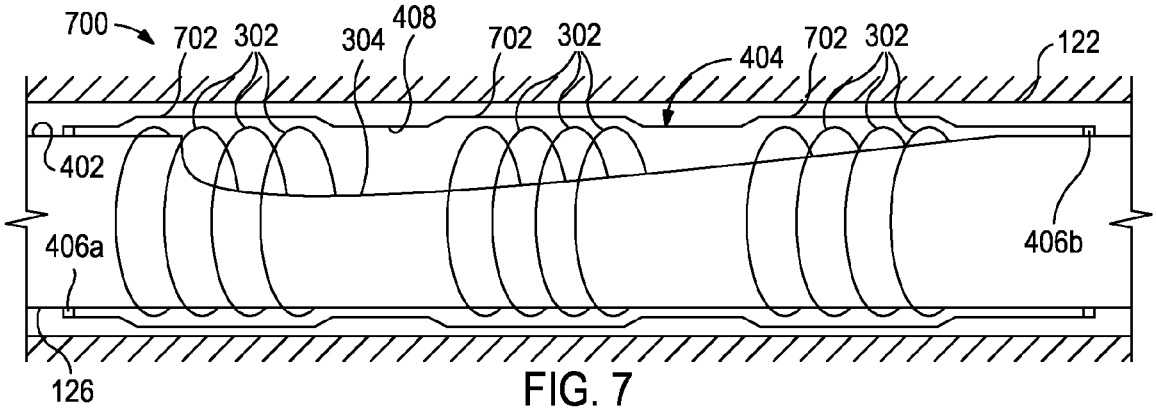
FIG. 7 illustrates another exemplary casing joint assembly, according to one or more embodiments.

Referring now to FIG. 7, illustrated is another exemplary casing joint assembly 700, according to one or more embodiments. The casing joint assembly 700 may be best understood with reference to FIGS. 1-6, where like numerals will indicate like elements not described again in detail. The casing joint assembly 700 may include the casing joint 126 and the one or more reinforcing members 302 arranged about the outer surface 402 of the casing joint 126. Similar to the casing joint assembly 400 of FIG. 4, the window 304 may be pre-milled in the casing joint 126 before its introduction into the wellbore 122, and the sleeve 404 may again be arranged about the casing joint 126 and configured to generally align with or otherwise cover the window 304.

In order to help resist the collapse of the sleeve 404 into the window 304, the one or more reinforcing members 302 may be arranged into two or more discrete groupings between the sleeve 404 and the outer surface 402 of the casing joint 126 at two or more corresponding locations along the axial length of the casing joint 126. In order to accommodate or otherwise receive the two or more groupings of reinforcing members 302, the sleeve 404 may define or otherwise have formed therein a corresponding number of longitudinal deformations 702. Similar to the longitudinal deformation 410 of FIG. 4, each longitudinal deformation 702 may be characterized as radial expansion of the axial length of the sleeve 404 and exhibit an inner diameter that is greater than the inner diameter of the remaining, unexpanded portions of the sleeve 404. Moreover, each longitudinal deformation 702 may be configured to accommodate a corresponding grouping of the one or more reinforcing members 302, thereby encasing the one or more reinforcing members 302 about the outer surface of the casing joint 126.

In some embodiments, the one or more reinforcing members 302 may be coupled or otherwise attached to the outer surface 402 of the casing joint 126 using, for example, mechanical fasteners, welding or brazing, adhesives, snap rings, castellations, combinations thereof, or the like. In other embodiments, however, the one or more reinforcing members 302 may be coupled or otherwise attached to the inner surface 408 of the sleeve 404, without departing from the scope of the disclosure.

Figure 8:
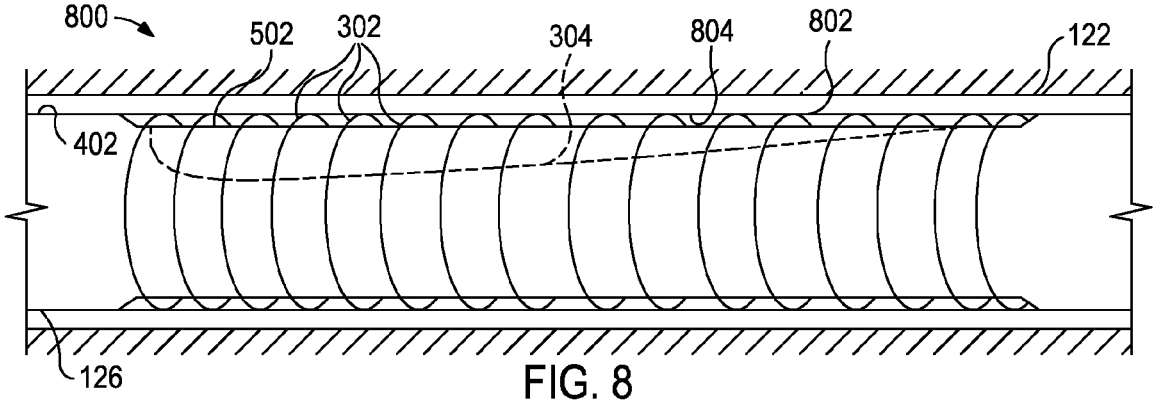
FIG. 8 illustrates another exemplary casing joint assembly, according to one or more embodiments.

Referring now to FIG. 8, illustrated is another exemplary casing joint assembly 800, according to one or more embodiments. The casing joint assembly 800 may be best understood with reference to FIGS. 1-2 and 5, where like numerals will indicate like elements not described again. The casing joint assembly 800 may include the casing joint 126 and the one or more reinforcing members 302 arranged about the outer surface 402 of the casing joint 126. Similar to the casing joint assembly 500 of FIG. 5, the casing joint 126 may have the longitudinal deformation 502 formed or otherwise defined therein. Specifically, the longitudinal deformation 502 may be a radial indentation in the casing joint 126 that exhibits a smaller inner diameter than the remaining un-indented portions of the casing joint 126. The longitudinal deformation 502 may be configured to accommodate or otherwise receive the one or more reinforcing members 302 thereabout.

The casing joint assembly 800 may further include a sleeve 802 generally arranged about the casing joint 126 and configured to substantially encase or otherwise surround the one or more reinforcing members 302 arranged within the longitudinal deformation 502. In one or more embodiments, the longitudinal deformation 502 may be sized so as to accommodate both the sleeve 802 and the one or more reinforcing members 302 therein, such that the outer diameter of the sleeve 802 may be substantially flush with the outer surface 402 of the casing joint 126. A flush configuration of the casing joint 126 and sleeve 802 may prove advantageous since a non-flush configuration may obstruct or otherwise impede the advancement as the casing joint 126 as it is being introduced into the wellbore 122.

The sleeve 802, according to various embodiments, may have any suitable configuration, including configurations that surround the entire circumference of the casing joint 126 and configurations that only extend about a portion of the circumference of the casing joint 126. In some embodiments, the sleeve 802 may be substantially the same as the sleeve 404 described above with reference to FIG. 4 and flush mounted to the casing joint 126 using attachment means known to those skilled in the art. In other embodiments, however, the sleeve 802 may be characterized as an outer liner made of softer or weaker material than that of the sleeve 404 of FIG. 4. Suitable materials for the sleeve 802 include, but are not limited to, fiberglass, carbon fiber, injection molded plastic, fabric reinforced polymer, para-aramid synthetic fiber, silicon carbide, low carbon steel, ceramic composites, combinations thereof, or the like.

In some embodiments, the one or more reinforcing members 302 are coupled or otherwise attached to the outer surface 402 of the casing joint 126 using a variety of techniques including, but not limited to, mechanical fasteners, welding or brazing, adhesives, snap rings, castellations, combinations thereof, or the like. In other embodiments, however, the one or more reinforcing members 302 may be coupled or otherwise attached to an inner surface 804 of the sleeve 802, without departing from the scope of the disclosure. In either case, the one or more reinforcing elements 302 may be configured to provide added radial support to the casing joint 126 in order to help oppose the elevated collapse pressures exhibited by the wellbore 122, and thereby increase the collapse pressure rating of the casing joint 126.

Figure 9:
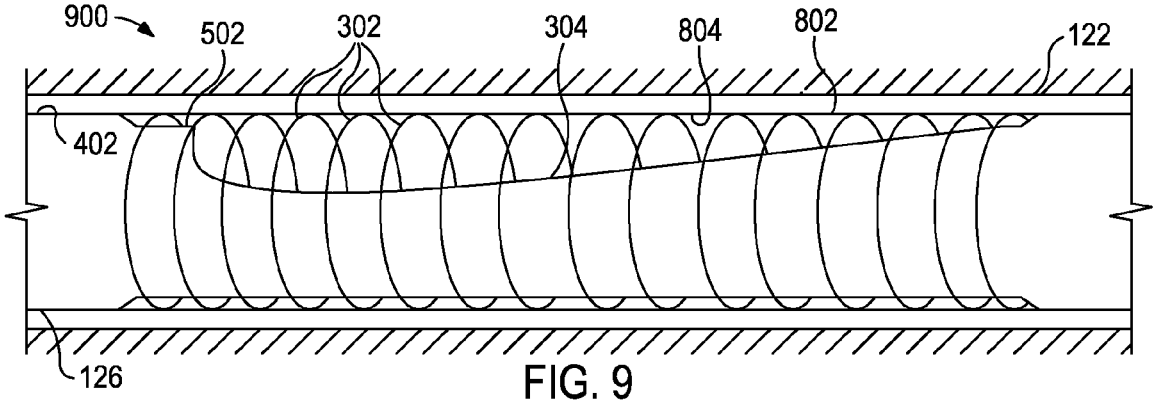
FIG. 9 illustrates another exemplary casing joint assembly, according to one or more embodiments.

Referring now to FIG. 9, with continued reference to FIG. 8, illustrated is another casing joint assembly 900, according to one or more embodiments. The casing joint assembly 900 is substantially similar to the casing joint assembly 800 of FIG. 8 and therefore may be best understood with reference thereto, where like numerals represent like elements. Unlike the casing joint assembly 800, however, the casing joint 126 in FIG. 9 has the window 304 pre-milled therein before it is to be introduced into the wellbore 122. In operation, the one or more reinforcing members 302 may be configured to provide radial support to the sleeve 802 against the elevated collapse pressures exhibited by the wellbore 122, and thereby help prevent the sleeve 802 from collapsing into the window 304. Consequently, the one or more reinforcing members 302 may be configured to increase the collapse pressure rating of the sleeve 802.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A casing joint assembly, comprising:

a casing joint;

one or more reinforcing members arranged within the casing joint and biasing an inner surface of the casing joint; and one or more longitudinal deformations defined in the casing joint and being configured to receive the one or more reinforcing members therein, the one or more longitudinal deformations exhibiting a greater inner diameter than remaining portions of the casing joint, wherein the one or more reinforcing members provide radial support to the casing joint.

2. The casing joint assembly of claim 1, wherein the one or more reinforcing members are coupled to the inner surface of the casing joint.

3. The casing joint assembly of claim 1, wherein the one or more reinforcing members are one or more helical springs.

4. The casing joint assembly of claim 1, wherein the one or more reinforcing members are a plurality of rings.

5. The casing joint assembly of claim 1, wherein the one or more reinforcing members are made of one of aluminum alloys, copper alloys, steel alloys, shape memory materials, plastics, fiberglass, and carbon fiber.

6. The casing joint assembly of claim 1, wherein each longitudinal deformation receives a corresponding grouping of the one or more reinforcing members.

7. A method of increasing the collapse pressure rating of a casing joint, comprising:

arranging one or more reinforcing members within a casing joint, the one or more reinforcing members biasing an inner surface of the casing joint;

receiving the one or more reinforcing members in one or more longitudinal deformations defined in the casing joint, each longitudinal deformation exhibiting a greater inner diameter than remaining unexpanded portions of the casing joint; and radially supporting the casing joint with the one or more reinforcing members.

8. The method of claim 7, further comprising coupling the one or more reinforcing members to the inner surface of the casing joint.

9. A casing joint assembly, comprising:

a casing joint having a pre-milled window defined therein;

a sleeve arranged at least partially about the casing joint and configured to cover the pre-milled window; and one or more reinforcing members arranged about the casing joint and interposing the casing joint and the sleeve, the one or more reinforcing members being configured to provide radial support to the sleeve.

10. The casing joint assembly of claim 9, wherein the one or more reinforcing members are one or more helical springs.

11. The casing joint assembly of claim 9, wherein the one or more reinforcing members are a plurality of rings.

12. The casing joint assembly of claim 9, further comprising one or more longitudinal deformations defined in the sleeve and configured to receive the one or more reinforcing members therein, the one or more longitudinal deformations exhibiting a greater inner diameter than remaining portions of the sleeve.

13. The casing joint assembly of claim 12, wherein each longitudinal deformation receives a corresponding grouping of the one or more reinforcing members.

14. The casing joint assembly of claim 9, wherein the one or more reinforcing members are coupled to an outer surface of the casing joint.

15. The casing joint assembly of claim 9, wherein the one or more reinforcing members are coupled to an inner surface of the sleeve.

16. The casing joint assembly of claim 9, further comprising a longitudinal deformation defined in the casing joint and being configured to receive the one or more reinforcing members therein, the longitudinal deformation exhibiting a smaller inner diameter than remaining portions of the casing joint.

17. The casing joint assembly of claim 16, wherein the longitudinal deformation is also configured to receive the sleeve therein such that an outer diameter of the sleeve is substantially flush with the outer surface of the casing joint.

18. The casing joint assembly of claim 9, wherein the one or more reinforcing members are made of one of aluminum alloys, copper alloys, steel alloys, shape memory materials, plastics, fiberglass, and carbon fiber.

19. A method of increasing the collapse pressure rating of a casing joint, comprising:

arranging a sleeve at least partially about a casing joint having a pre-milled window defined therein, the sleeve being configured to substantially cover the pre-milled window;

arranging one or more reinforcing members about the casing joint and interposing the casing joint and the sleeve; and radially supporting the sleeve with the one or more reinforcing members.

20. The method of claim 19, further comprising receiving the one or more reinforcing members in one or more longitudinal deformations defined in the sleeve, the one or more longitudinal deformations exhibiting a greater inner diameter than remaining portions of the sleeve.

21. The method of claim 19, further comprising coupling the one or more reinforcing members to an outer surface of the casing joint.

22. The method of claim 19, further comprising coupling the one or more reinforcing members to an inner surface of the sleeve.

23. The method of claim 19, further comprising receiving the one or more reinforcing members in a longitudinal deformation defined in the casing joint, the longitudinal deformation exhibiting a smaller inner diameter than remaining portions of the casing joint.

* * * * *